US007543685B2

(12) United States Patent
Ach et al.

(10) Patent No.: US 7,543,685 B2
(45) Date of Patent: Jun. 9, 2009

(54) ELEVATOR

(75) Inventors: Ernst Ach, Ebikon (CH); Gert Silberhorn, Rigi (CH); Peter Spless, Meggen (CH); Karl Weinberger, Cham (CH)

(73) Assignee: Inventio AG, Hergiswil NW (CH)

( * ) Notice: Subject to any disclaimer, the term of this patent is extended or adjusted under 35 U.S.C. 154(b) by 86 days.

(21) Appl. No.: 11/215,901

(22) Filed: Aug. 31, 2005

(65) Prior Publication Data

US 2006/0070818 A1 Apr. 6, 2006

(51) Int. Cl.
*B66B 9/02* (2006.01)
*B66B 11/04* (2006.01)

(52) U.S. Cl. ..... 187/250; 187/252; 187/411

(58) Field of Classification Search ..... 187/411, 187/252, 250
See application file for complete search history.

(56) References Cited

U.S. PATENT DOCUMENTS 6,006,865 A * 12/1999 Ammon ..... 187/266
6,138,799 A * 10/2000 Schroder-Brumloop et al. .. 187/252
6,425,463 B1 * 7/2002 Broyan ..... 187/411
6,655,500 B2 * 12/2003 Orrman et al. ..... 187/254
6,776,263 B2 * 8/2004 Gottlieb et al. ..... 187/251
2002/0000347 A1 * 1/2002 Baranda et al. ..... 187/254

FOREIGN PATENT DOCUMENTS

| | | | |
|---|---|---|---|
| DE | 911 777 | C | 12/1955 |
| EP | 0 837 025 | | 4/1998 |
| EP | 0 837 025 | A | 4/1998 |
| EP | 1 327 598 | | 7/2003 |
| EP | 1327598 | A1 * | 7/2003 |
| WO | WO 99/43593 | | 9/1999 |
| WO | WO 99 43593 | A | 9/1999 |
| WO | WO 9943593 | A1 * | 9/1999 |

* cited by examiner

*Primary Examiner*—Patrick H Mackey
*Assistant Examiner*—Terrell H Matthews
(74) *Attorney, Agent, or Firm*—Fraser Clemens Martin & Miller LLC; William J. Clemens

(57) ABSTRACT

An elevator has a mechanical linear drive arranged laterally at an elevator shaft head to drive at least one belt that moves a car and a counterweight in the shaft. The belt is fixed in the shaft at opposite ends and extends about a drive wheel of the elevator drive. Deflection rollers of the drive determine the angle of encirclement of the belt on the drive wheel.

8 Claims, 8 Drawing Sheets

ELEVATOR

BACKGROUND OF THE INVENTION

The present invention relates to an elevator consisting of an elevator car movable in an elevator shaft and a counterweight, wherein the elevator car and the counterweight are connected by way of a support means guided over redirecting rollers and wherein a drive drives the elevator car and the counterweight.

An elevator installation is shown in the U.S. Pat. No. 6,138,799 in which an elevator car and a counterweight are movable in an elevator shaft along guide rails. The elevator car and the counterweight are connected by means of cables, wherein a 2:1 cable guidance with underslinging of the elevator car is provided. The cable ends are each arranged at the upper end of the elevator shaft. A mechanical linear drive is arranged on the counterweight. A stationary cogged belt is provided as a drive means and is stretched between a shaft pit and a shaft head. The cogged belt loops around a gearwheel of the mechanical linear drive, wherein the drive climbs along the stationary belt.

A disadvantage of this known equipment is that high production costs arise with the separate supporting means and drive means. In addition, the elevator functions only reliably with a correctly tightened cogged belt. Moreover, the problem of energy feed to the counterweight has to be solved by drag cables.

SUMMARY OF THE INVENTION

The present invention meets the object of avoiding the disadvantages of the known equipment and of creating a competitive elevator with a mechanical linear drive and preferably belt-shaped drive means. In that case the running direction of the drive means does not need to be changed by the linear drive itself. Only if it appears advantageous due to the space conditions in the shaft is a corresponding redirection provided in the linear drive itself.

The advantages achieved by the present invention are that the linear drive can be mounted in a space-saving manner along the drive means. The shaft head is suitable particularly for different arrangement variants and driving or supporting means guide variants. The linear drive can be installed, depending on the respective power and mechanical dimensions, in the shaft head at the most suitable location, for example in a corner, without reducing the safety space. Moreover, the linear drive operates with large redirection angles and without transverse forces.

DESCRIPTION OF THE DRAWINGS

The above as well as other advantages of the present invention will become readily apparent to those skilled in the art from the following detailed description of a preferred embodiment when considered in the light of the accompanying drawings in which.

DESCRIPTION OF THE PREFERRED EMBODIMENT

Figure 1:
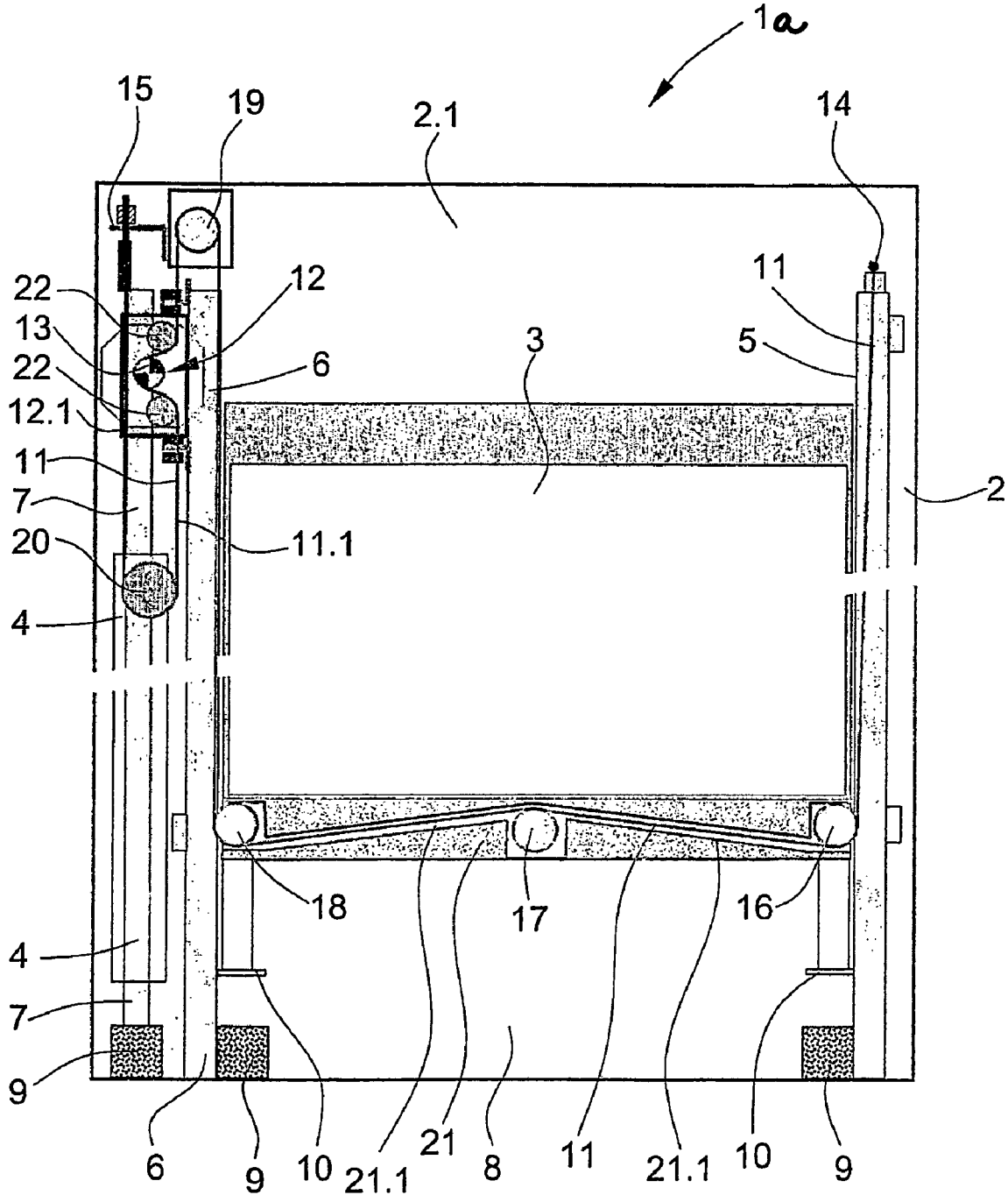
FIG. 1 is a schematic elevation view of an elevator according to the present invention with a mechanical linear drive arranged laterally adjacent the top of the elevator shaft.

An elevator denoted by 1*a* and consisting of a car 3 and a counterweight 4 movable in an elevator shaft 2 is illustrated in FIG. 1. The elevator 1*a* offers free space in the shaft head for over-travels. The elevator car 3 is guided by means of a first guide rail 5 and by means of a second guide rail 6. The counterweight 4 is guided by means of a third guide rail 7 and by means of a fourth guide rail (not illustrated). The guide rails are supported in a shaft pit 8, wherein the vertical forces are conducted into the shaft pit 8. The guide rails 5, 6, 7 are connected by brackets (not illustrated) with the shaft wall. Buffers 9, on which buffer plates 10 of the elevator car or the counterweight 4 can be placed, are arranged in the shaft pit 8.

At least one belt 11, preferably a cogged belt, with a 2:1 belt guide is provided as a supporting and driving device. If a mechanical linear drive 12 laterally arranged at the second guide rail 6, for example in the shaft head 2.1, drives the belt 11 at a vertical belt portion 11.1 in looping manner by means of a drive wheel 13 through one unit, the elevator car 3 or the counterweight 4 moves vertically by a half unit. One end of the belt 11 is arranged at a first belt fixing point 14 and the second end of the belt 11 is arranged at the second belt fixing point 15. The belt 11 is guided over a first redirecting roller 16, over a profiled roller 17, over a second redirecting roller 18, over a third redirecting roller 19, over the drive wheel 13 and over a fourth redirecting roller 20. The first redirecting roller 16, the second redirecting roller 18 and the profile roller 17 are integrated in a floor 21 of the elevator car 3, wherein the belt runs in a floor channel 21.1. The profiled roller 17 has a toothing corresponding with the toothing of the belt 11. The first redirecting roller 16 and the second redirecting roller 18 guide the belt on the untoothed side by means of flanges arranged at the end faces. The third redirecting roller 19 arranged at the second guide rail 6 is disposed by its toothing in engagement with the toothed side of the belt 11 and has a brake for normal operation. The drive wheel 13 is disposed by its toothing in engagement with the toothed side of the belt 11. Deflecting rollers 22 of the linear drive 12 produce the looping angle of the belt 11 at the drive wheel 13. The drive wheel 13 can also be one of the deflecting rollers 22. Not illustrated is or are the motor or the motors for the drive wheel 13. The fourth redirecting roller 20 is arranged in the counterweight and is comparable in construction with the first redirecting roller 16 or with the second redirecting roller 18.

As the belt 11 there can be provided, instead of a cogged belt, a flat belt or a wedge-ribbed belt. The wedge-ribbed belt provided with longitudinal ribs has good guidance characteristics and an increased traction capability. Such flat belts contain steel or synthetic strands of approximately 0.5 millimeters to 3 millimeters. Two belts guided in parallel can also be provided, wherein in addition the redirecting rollers or the deflecting rollers or the drive wheel can be doubled. Redirecting rollers or deflecting rollers or the drive wheel can be, for example, 50 millimeters size in diameter or larger. A motor can also be present per drive wheel. The motor can be, for example, an asynchronous motor or a synchronous motor with or without permanent magnets.

Figure 2:
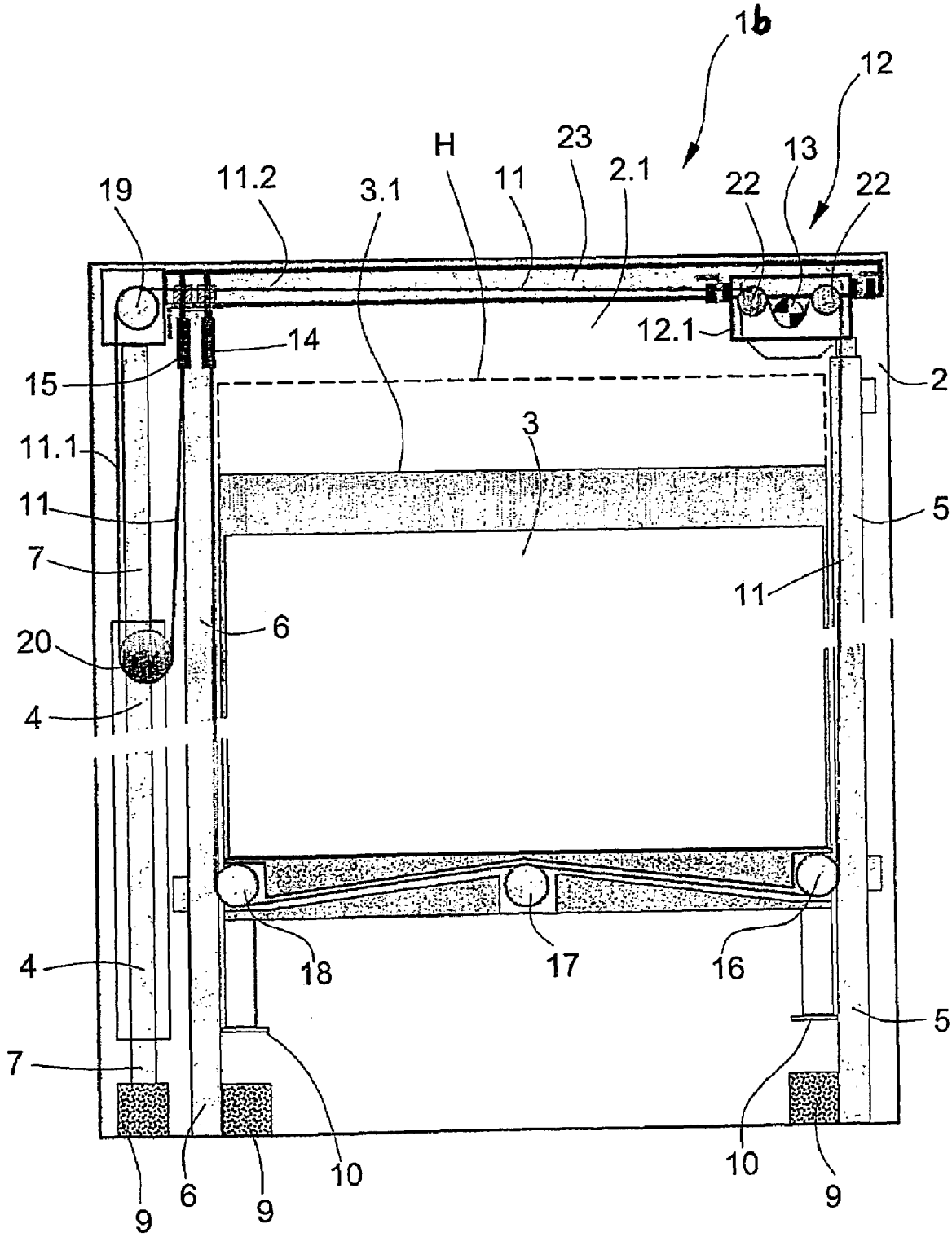
FIG. 2 is a schematic elevation view of an elevator according to a second embodiment of the present invention with a mechanical drive arranged at the top of the elevator shaft.

FIG. 2 shows an elevator 1*b* with the mechanical linear drive 12 arranged at the top in a horizontal belt run 11.2. In the case of the illustrated belt guide the belt has a bend in the same sense. The linear drive 12 is connected by means of its housing 12.1 with the first guide rail 5 and with a cross member 23. One of the deflecting rollers 22 serves at the same time as a redirecting roller which redirects the belt run from the vertical to the horizontal or conversely. The other end of the cross member 23 is carried by the second guide rail 6, at which the third redirecting roller 19 together with a brake is arranged. Moreover, the two cable fixing points 14, 15 are arranged at the other end of the cross member 23. The elevator car 3 can travel by its upper edge 3.1 at most to a height H symbolized by dashed lines.

Figure 3:
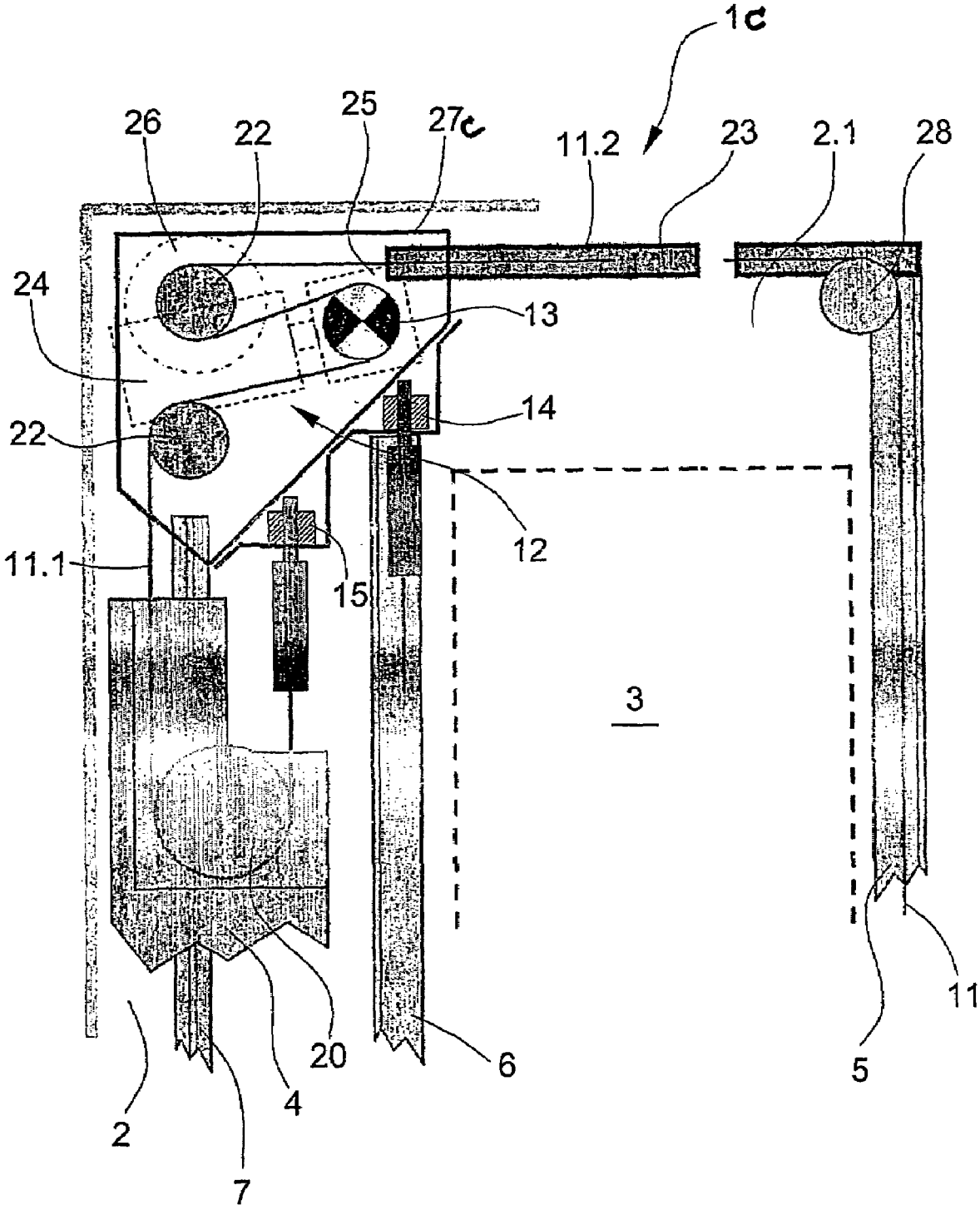
FIG. 3 is a fragmentary schematic elevation view of an elevator according to a third embodiment of the present invention with a mechanical linear drive arranged laterally adjacent the top of the elevator shaft and having a transmission.

FIG. 3 shows an elevator 1*c* with a mechanical linear drive, which is arranged laterally at the top in the vertical belt run 11.1 and is supported on the guide rails 6, 7, with a motor 24 and a transmission 25 in a housing 27*c*. The increased distance for reciprocal bending preserves the belt 11. One of the deflecting rollers 22 serves at the same time as a redirecting roller and is provided with a brake 26. The elevator car 3 can travel to a position directly below the linear drive 12 as shown in dashed line.

Figure 4:
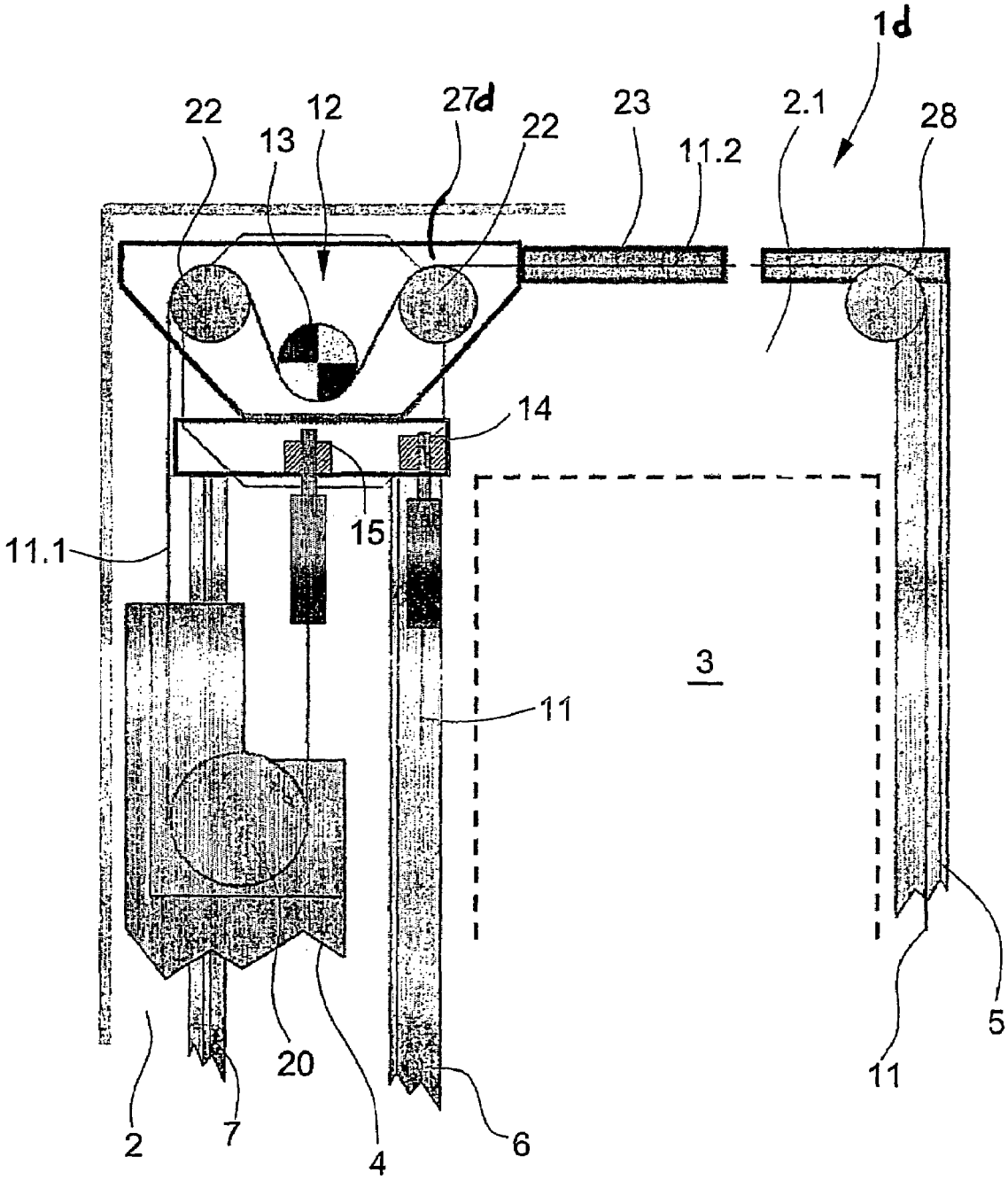
FIG. 4 is a fragmentary schematic elevation view of an elevator according to a fourth embodiment of the present invention with a mechanical linear drive arranged laterally adjacent the top of the elevator shaft.

FIG. 4 shows an elevator 1*d* with the mechanical linear drive 12 arranged laterally at the top in the horizontal belt run 11.2 and supported on the guide rails 6, 7, wherein one of the deflecting rollers 22 at the same time serves as redirecting roller and is provided with a brake (not shown). A housing 27*d* of the linear drive 12 is connected with the cross member 23. This variant offers optimum space utilization above the counterweight 4.

Figure 5:
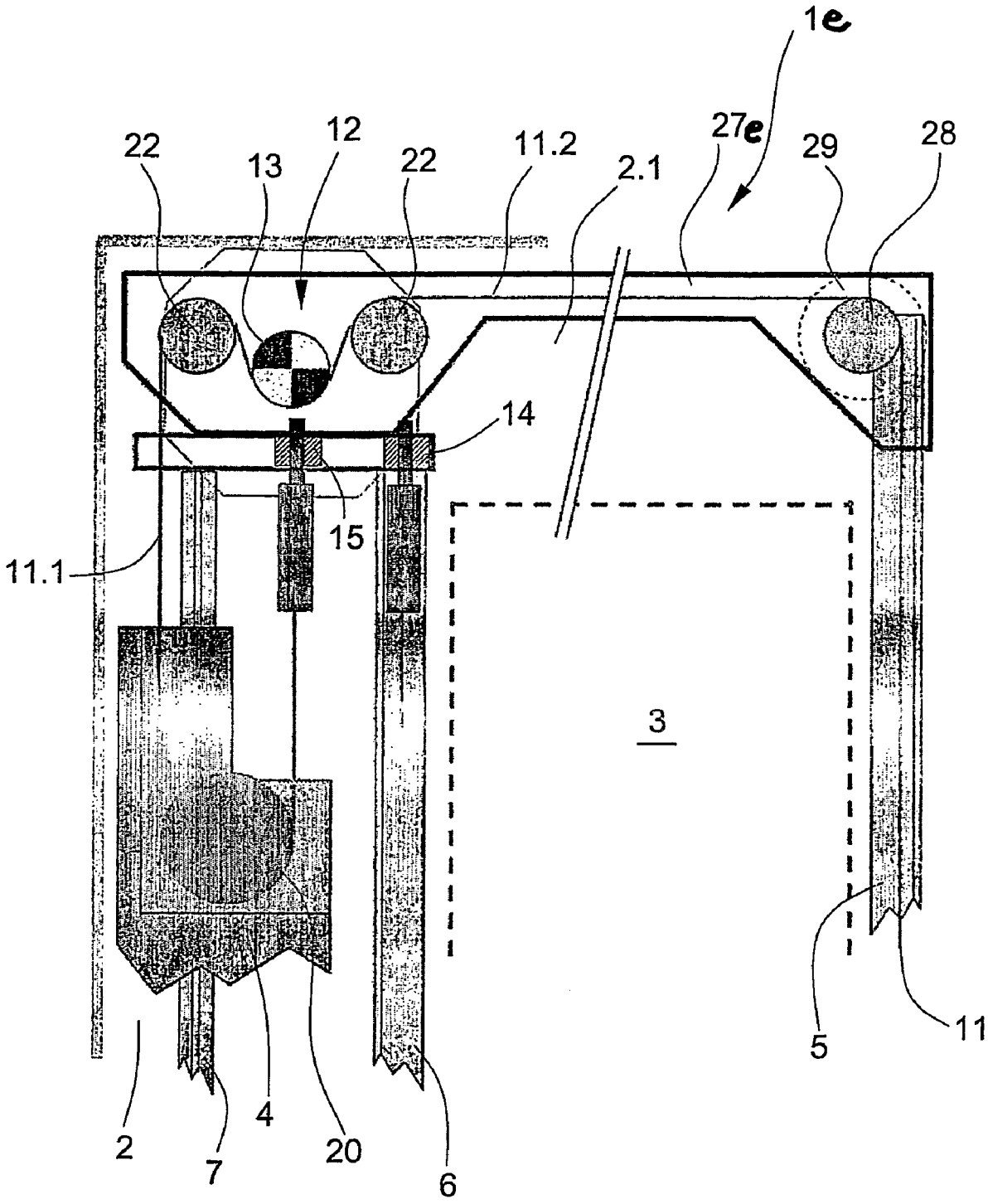
FIG. 5 is a fragmentary schematic elevation view of an elevator according to a fifth embodiment of the present invention with a mechanical linear drive arranged laterally adjacent the top of the elevator shaft with a redirecting roller having brake.

FIG. 5 shows an elevator 1*e* with the mechanical linear drive 12 arranged laterally at the top in the horizontal belt run 11.2 and supported on the guide rails 6, 7, wherein one of the deflecting rollers 22 at the same time serves as a redirecting roller and is provided with a brake (not shown). A housing 27*e* of the linear drive 12 serves at the same time as a cross member. A fifth redirecting roller 28 is provided with a brake 29. This embodiment avoids transverse forces acting on the rails and offers belt protection.

In the case of the embodiments of FIGS. 1 to 5 the direction of the belt run at the outlet of the linear motor 12 changes relative to the direction of the belt run at the inlet of the linear drive 12 at most by approximately 90°, wherein the inlet or outlet of the linear drive 12 is at the deflecting rollers 22. In the case of the embodiment according to FIG. 1 the direction of the belt run running out is the same as the direction of the belt run running in. In the case of the embodiments according to FIGS. 2 to 5 the direction of the belt run changes from the vertical to the horizontal or conversely.

Figure 6:
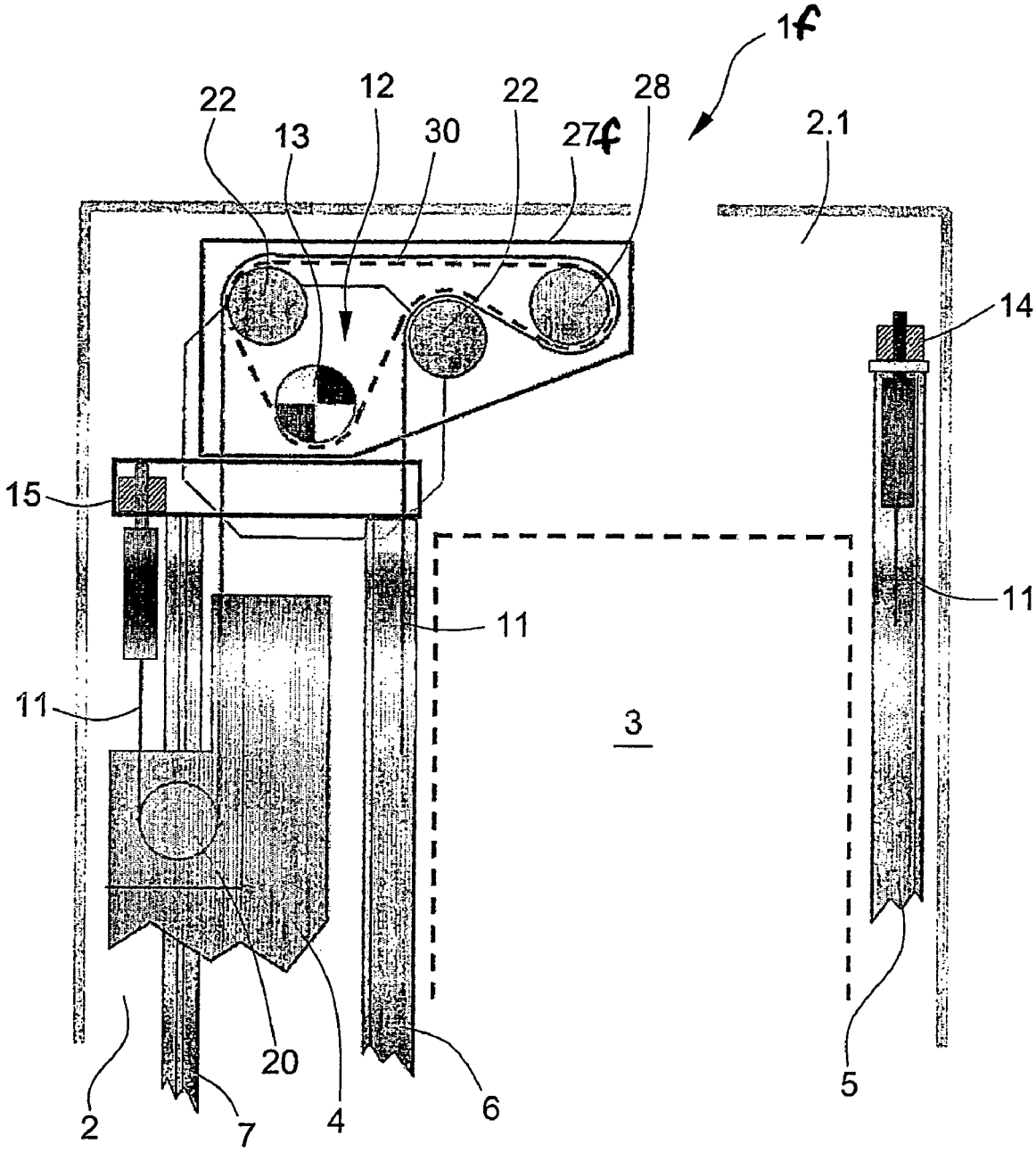
FIG. 6 is a fragmentary schematic elevation view of an elevator according to a sixth embodiment of the present invention with a mechanical linear drive arranged laterally adjacent the top of the elevator shaft with a drive belt.

FIG. 6 shows an elevator if with the mechanical linear drive 12, which is arranged laterally at the top and supported on the guide rails 6, 7 with a drive belt 30 that drives the belt 11. Functionally identical components are provided with the same reference numerals as in the case of the preceding examples of the various embodiments. The drive belt 30 is placed under the belt 11 and guided over the fifth redirecting roller 28, which is integrated in a housing 27*f*. This embodiment is distinguished by a large amount of looping. Moreover, the drive belt 30 makes possible small bending radii and freedom of positioning for the traction pulley 13.

Figure 7:
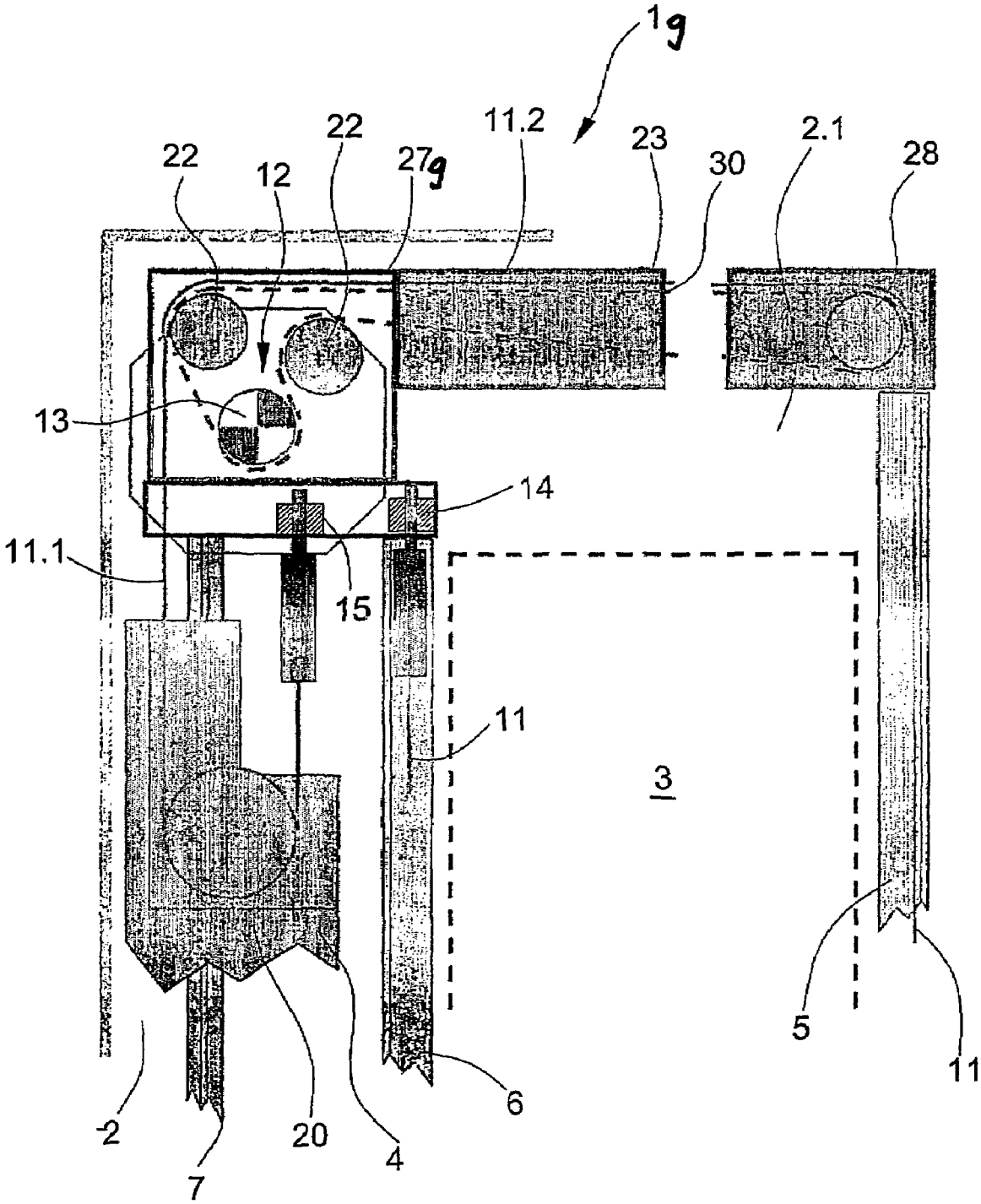
FIG. 7 is a fragmentary schematic elevation view of an elevator according to a seventh embodiment of the present invention with a mechanical linear drive arranged laterally adjacent the top of the elevator shaft with a drive belt via a redirecting roller.

FIG. 7 shows an elevator 1*g* with the mechanical linear drive 12 in a housing 27*g*, which is arranged laterally at the top and supported on the guide rails 6, 7, with the drive belt 30 which is guided over the fifth redirecting roller 28 and which drives the belt 11. The fifth redirecting roller 28 is arranged above the first guide rail 5. Functionally identical components are provided with the same reference numerals as in the case of the preceding embodiments. This embodiment enables belt guidance in a preserving manner without reciprocal bending and with a large looping angle.

In the case of the embodiments of FIGS. 6 and 7 as well, the direction of the belt run at the linear motor itself changes only by 90°. However, for optimization of the cable guidance the redirecting rollers are arranged downstream in order to adapt the belt or cable departure point to the disposition of the car.

As already explained above, the redirecting rollers or the deflecting rollers or the drive wheel can have a diameter of approximately 50 millimeters. The following example shows the advantageous dimensions or the advantageous weight of the mechanical linear drive in relation to the counterweight and to the elevator car:

diameter of the deflecting roller—53 millimeters diameter of the drive wheel—50 millimeters spacing of the deflecting roller from the drive wheel—60 millimeters looping angle of the belt at the drive wheel—137° dimensions of the complete linear drive with two motors (installation according to FIG. 1)—270 millimeters height, 150 millimeters width, 750 millimeters depth dimensions of the counterweight—1600 millimeters height, 100 millimeters width, 610 millimeters depth weight of linear drive without motor—23 kilograms weight with two motors—75 kilograms weight of counterweight—1000 kilograms weight of elevator car—630 kilograms (with 675 kilograms of useful load)

The advantageous dimensions or the advantageous weight of the mechanical linear drive allows or allow an installation which is independent in terms of position even in the case of unfavorable space conditions. The characteristics of thin belts, which permit small bending radii, can thus be fully utilized.

Figure 8:
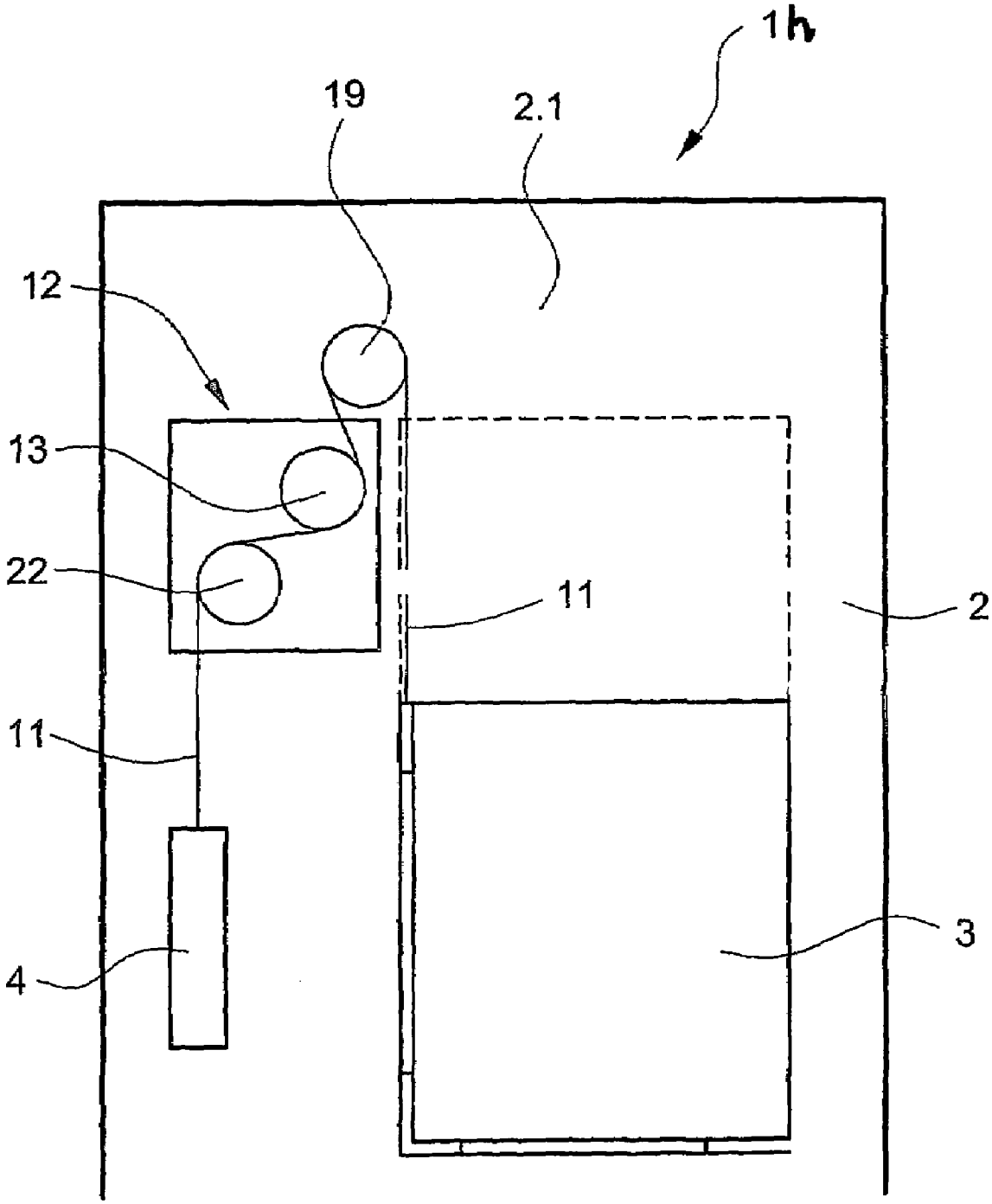
FIG. 8 is a schematic elevation view of a cantilever-mounted elevator according to an eighth embodiment of the present invention with a mechanical linear drive.

As shown in FIG. 8, the mechanical linear drive 12 can also be used in the case of an elevator 1*h*, for example in the case of a cantilever-mounted elevator with a 1:1 belt guide, in which one belt end is arranged at the elevator car 3 and the other belt end at the counterweight 4. The linear drive 12 is arranged between the travel path of the elevator car 3 and the shaft wall, wherein the elevator car 3 can move past the linear drive 12. The linear drive 12 substantially consists of the drive wheel 13, the deflecting roller 22 and a drive (not illustrated). The function of the second deflecting roller 22 is taken over by the redirecting roller 19, wherein a looping angle of the belt 11 at the drive wheel 13 of, for example, approximately 137° is achieved. The redirecting roller 19 can also be equipped with a brake. The linear drive 12 shown in FIG. 8 can, for example, also be used for the elevator installation according to FIG. 1.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. An elevator having an elevator car and a counterweight movable in an elevator shaft, a supporting and driving device connecting the car and the counterweight is guided over redirecting rollers and an elevator drive that drives the supporting and connecting device to move the elevator car and the counterweight comprising:

a mechanical drive being the elevator drive and being arranged at a head of the elevator shaft;

a belt included in the supporting and driving device and being connected to the car and the counterweight with a 2:1 belt guide;

said mechanical drive having at least one drive wheel driven by said mechanical drive; and said mechanical drive having a pair of deflecting rollers adjacent said drive wheel, said deflecting rollers looping said belt about said drive wheel whereby said belt engages said drive wheel and said deflecting rollers and a direction of a belt run at an outlet of said mechanical drive is changed in a range of approximately 0° to approximately 90° relative to a direction of a belt run at an inlet of said mechanical drive.

2. The elevator according to claim 1 wherein at least one of said deflecting rollers serves as a redirecting roller which redirects one of the belt runs between a vertical direction and a horizontal direction.

3. The elevator according to claim 1 wherein said mechanical drive includes a drive belt underlying and driving said belt connected to the car and the counterweight, said drive belt engaging said drive wheel and coupling said belt to said drive wheel.

4. The elevator according to claim 1 wherein said mechanical drive is arranged at an upper end of at least one guide rail in the elevator shaft.

5. The elevator according to claim 1 wherein said drive wheel and said deflecting rollers each have a diameter of approximately 50 millimeters.

6. The elevator according to claim 1 wherein said belt is formed of strands with a diameter of approximately 0.5 to 3 millimeters.

7. An elevator having an elevator car and a counterweight movable in an elevator shaft, a supporting and driving device connecting the car and the counterweight is guided over redirecting rollers and an elevator drive that drives the supporting and connecting device to move the elevator car and the counterweight comprising:

a mechanical drive being the elevator drive and being arranged in a shaft head of the elevator shaft;

the supporting and driving device inclnding a belt;

said mechanical drive having at least one drive wheel driven by said mechanical drive; and said mechanical drive having at least a pair of deflecting rollers adjacent said drive wheel looping said belt about said drive wheel, said belt engaging said at least one drive wheel and said deflecting rollers, whereby a direction of a belt run at an outlet of said mechanical drive is changed in a range of approximately 0° to approximately 90° relative to a direction of a belt run at an inlet of said mechanical drive and wherein a weight ratio of said mechanical drive to the counterweight is approximately 1:20 when said mechanical drive is one drive motor and is approximately 1:13 when said mechanical drive is two drive motors.

8. An elevator having an elevator car and a counterweight movable in an elevator shaft, a supporting and driving device connecting the car and the counterweight is guided over redirecting rollers and an elevator drive that drives the supporting and connecting device to move the elevator car and the counterweight comprising:

a mechanical drive being the elevator drive and being arranged at a head of the elevator shaft;

a belt included in the supporting and driving device and being connected to the car and the counterweight with a 2:1 belt guide;

said mechanical drive having at least one drive wheel driven by said mechanical drive;

said mechanical drive having a pair of deflecting rollers adjacent said drive wheel, said deflecting rollers looping said belt about said drive wheel whereby a direction of a belt run at an outlet of said mechanical drive is changed by at least approximately 90° relative to a direction of a belt run at an inlet of said mechanical drive; and said mechanical drive including a drive belt underlying and driving said belt connected to the car and the counterweight.

* * * * *

UNITED STATES PATENT AND TRADEMARK OFFICE

CERTIFICATE OF CORRECTION

PATENT NO. : 7,543,685 B2
APPLICATION NO. : 11/215901
DATED : June 9, 2009
INVENTOR(S) : Ernst Ach et al.

It is certified that error appears in the above-identified patent and that said Letters Patent is hereby corrected as shown below:

Cover Page, item [60] insert the following --This application is a CON of PCT/CH04/00108 03/01/2004--

Cover Page, item [30] Priority Document: insert the following --EUROPEAN PATENT OFFICE (EPO) 03405155.7 03/06/2003--

Signed and Sealed this

Eighth Day of September, 2009

David J. Kappos

David J. Kappos
*Director of the United States Patent and Trademark Office*